US006915539B2

(12) United States Patent
Rathbun

(10) Patent No.: US 6,915,539 B2
(45) Date of Patent: Jul. 12, 2005

(54) PILLOW

(76) Inventor: Gordon Rathbun, 1720 Meadowvale Dr., South Lake Tahoe, CA (US) 96150

( * ) Notice: Subject to any disclaimer, the term of this patent is extended or adjusted under 35 U.S.C. 154(b) by 0 days.

(21) Appl. No.: 10/435,169

(22) Filed: May 9, 2003

(65) Prior Publication Data

US 2003/0188385 A1 Oct. 9, 2003

Related U.S. Application Data

(63) Continuation-in-part of application No. 09/679,798, filed on Oct. 5, 2000, now Pat. No. 6,574,809

(60) Provisional application No. 60/157,966, filed on Oct. 6, 1999.

(51) Int. Cl.[7] ..... A47G 9/00

(52) U.S. Cl. ..... 5/636; 5/640

(58) Field of Search ..... 5/636–645; D6/601

(56) References Cited

U.S. PATENT DOCUMENTS 388,648 A * 8/1888 Durgin ..... 368/306

5,708,998 A * 1/1998 Torbik ..... 5/636

* cited by examiner

*Primary Examiner*—Alexander Grosz

(74) *Attorney, Agent, or Firm*—Armstrong Teasdale LLP

(57) ABSTRACT

A pillow includes a first body portion and a continuous second body portion that extends from the first body portion. The first body portion includes a top edge and a bottom edge connected by a first side edge and a second side edge. The second body portion extends continuously from the top edge to the bottom edge, and continuously between the first and second side edges. The first body portion is substantially rectangular-shaped. The second body portion defines at least one recess, wherein the recess is bordered by a continuous sidewall formed by the second body portion. The recess sidewall extends arcuately from at least one of the first side edge and the second side edge. The pillow also includes an axis of symmetry that extends from the top edge to the pillow bottom edge.

15 Claims, 6 Drawing Sheets

PILLOW

CROSS REFERENCE TO RELATED APPLICATION

This application is a continuation-in-part of U.S. Pat. No. 6,574,809 B1 application Ser. No. 09/679,798 filed Oct. 5, 2000 issued Jun. 10, 2003, which claimed the benefit of U.S. Provisional Application No. 60/157,966, filed Oct. 6, 1999.

BACKGROUND OF THE INVENTION

This invention relates generally to pillows and, more particularly, to pillows which reduce wrinkles on a person's face while resting on the pillow.

Despite a plurality of skin care products, when a person sleeps on their side and rests their head on a pillow, the pillow may accelerate facial wrinkling especially in the delicate skin areas surrounding the eyes, cheeks, and nose. Known pillows apply a uniform amount of support across the pillow. Pillow designs typically include a pliable body which includes foam, air, fluids, rubber, or feathers and which is symmetrical to provide a pre-selected amount of support uniformly across the body of the pillow. As a result, when a person sleeps on their side, the pillow simultaneously supports the person's face and head. The resulting pressure induced on the person's face may create stress lines or creases which over time may accelerate the person's facial wrinkling.

BRIEF SUMMARY OF THE INVENTION

In one aspect, a pillow is provided. The pillow includes a first body portion and a continuous second body portion that extends from the first body portion. The first body portion includes a top edge and a bottom edge connected by a first side edge and a second side edge. The second body portion extends continuously from the top edge to the bottom edge, and continuously between the first and second side edges. The first body portion is substantially rectangular-shaped. The second body portion defines at least one recess, wherein the recess is bordered by a continuous sidewall formed by the second body portion. The recess sidewall extends arcuately from at least one of the first side edge and the second side edge. The pillow also includes an axis of symmetry that extends from the top edge to the pillow bottom edge.

In another aspect, a pillow having a substantially rectangular shaped body is provided. The body includes a first side, a second side, a bottom side, a top side, and a plurality of recesses. Each of the recesses is bordered by a continuous wall portion that extends from at least one of the pillow first side and second sides. The pillow first side is connected to the second side with the top side and the bottom side. At least one of the pillow top side and the bottom side extends arcuately between the pillow first and second sides.

DETAILED DESCRIPTION OF THE INVENTION

Figure 1:
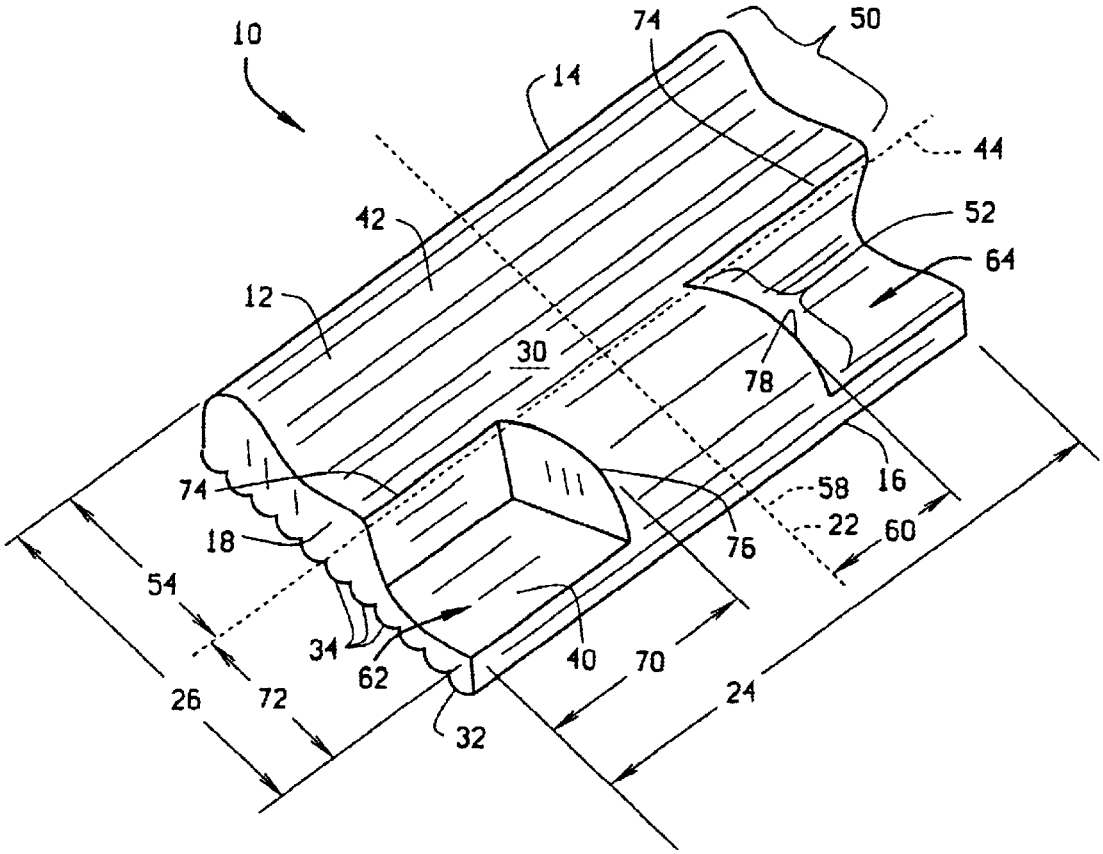
FIG. 1 is perspective view of a pillow.

FIG. 1 is a perspective view of a pillow 10 including a pliable body 12. Pillow 10 is substantially rectangular in shape and includes a top edge 14, a bottom edge 16 connected to top edge 14 with a first side 18 and a second side (not shown in FIG. 1), and an axis of symmetry 22 extending from top edge 14 to bottom edge 16. Pillow 10 includes a width 24 extending between first side 18 and the second side and a length 26 extending between top edge 14 and bottom edge 16. A top surface 30 extends from first side 18 to the second side and from top edge 14 to bottom edge 16. A bottom surface 32 extends from first side 18 to the second side and from top edge 14 to bottom edge 16. Bottom surface 32 includes a plurality of ridges 34 extending from first side 18 to the second side.

Body 12 is unitary and includes a first body portion 40 and a second body portion 42 extending from first body portion 40. First body portion 40 and second body portion 42 are fabricated from the same material (not shown). In one embodiment, first body portion 40 and second body portion 42 are constructed from a pliable material including foam rubber sponge or fiber material. In a second embodiment, first body portion 40 and second body portion 42 is be constructed from a down material.

First body portion 40 is substantially rectangular in shape and includes bottom surface 32 and an axis of symmetry 44. Axis of symmetry 44 extends from pillow first side 18 to the pillow second side and is substantially perpendicular to pillow axis of symmetry 22.

Second body portion 42 is substantially T-shaped and includes a first section 50 and a second section 52. In one embodiment, pillow second section 52 is a bladder construction which may be filled with air or fluid. First section 50 extends from first side 18 to the second side. Second body first section 50 has a length 54 extending from top edge 14 to second body portion second section 52. First section length 54 is less than pillow length 26. Top surface 30 extends over second body first section 50 and is a concave depression extending from first side 18 to the second side. Alternatively, second body portion first section 50 is constructed with top surface 30 being substantially flat.

Second body portion second section 52 extends from first section 50 to bottom edge 16. Second body portion second section 52 includes an axis of symmetry 58 substantially co-linear with pillow axis of symmetry 22. Top surface 30 extends over second section 52 and extends in a convex arch-like projection for a width 60. Width 60 extends between a first recess 62 and a second recess 64 and is less than pillow width 24.

Second body portion second section 52 supports a head (not shown in FIG. 1) of a person (not shown in FIG. 1) sleeping. When a person is sleeping on their back, facial wrinkling is not induced and second section concave top surface 30 supports the head and neck of the person sleeping. However, when a person sleeps on their side, delicate facial skin is placed in contact with a pillow. Pillow 10 includes recesses 62 and 64 extending from second body portion second section 52 to first side 18 and the second side respectively. In one embodiment, second body portion second section 52 includes a pair of depressions (not shown in FIG. 1) adjacent recesses 62 and 64, and extending into pillow 10 approximately 0.5 inches to receive a person's ear (not shown).

Each recess 62 and 64 has a width 70 extending from second section 52 to first side 18 and the second side, respectively, and a length 72 extending from second body portion first section 50 to bottom edge 16. Accordingly, each recess 62 and 64 and second body portion second section 52 permit a person to sleep on their side with their head supported by second body portion second section 52 while their face (not shown) is suspended above recesses 62 and 64. Because the person's face is not in contact with pillow 10, facial wrinkling is alleviated while the person is asleep.

Recess 62 is bordered by a lower edge 74 of second body portion first section 50 and a first edge 76 of second body portion second section 52. Recess 64 is bordered by lower edge 74 of second body portion first section 50 and a second edge 78 of second body portion second section 52.

Figure 2:
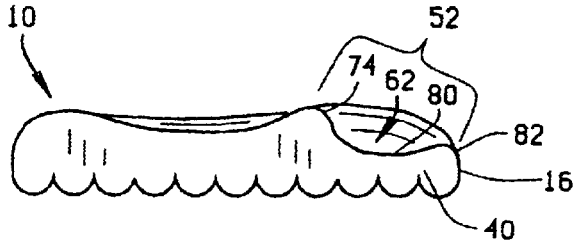
FIG. 2 is side elevational view of the pillow shown in FIG. 1.

FIG. 2 is side elevational view of pillow 10 including recess 62. Second body portion first section lower edge 74 borders recess 62 and is rounded to remove any sharp corners which may cause discomfort to the person (not shown in FIG. 2) sleeping. Recess 62 also includes a top surface 80 of first body portion 40. Top surface 80 is concave extending from second body portion first section 52 to pillow bottom edge 16. Alternatively, pillow 10 is fabricated such that top surface 80 is substantially flat between bottom edge 16 and second body portion first section 52. Bottom edge 16 includes a top edge 82 which is rounded to remove any sharp corners which may cause any discomfort to the person sleeping on pillow 10. Recess 64 is constructed identically to recess 62.

Figure 3:
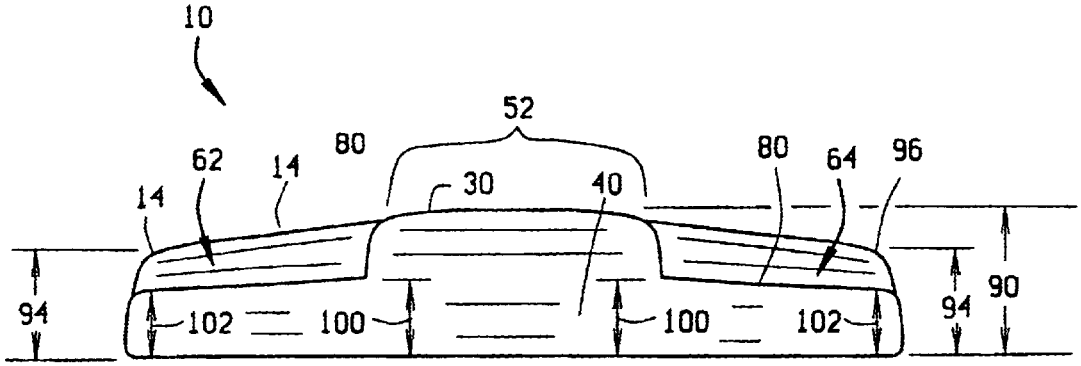
FIG. 3 a front elevational view of the pillow shown in FIG. 1.

FIG. 3 is a front elevational view of pillow 10 including bottom edge 16. Pillow 10 has a first thickness 90 extending between pillow top surface 30 to pillow bottom surface 32. First thickness 90 extends along pillow axis of symmetry 22 (shown in FIG. 1) between pillow top edge 14 and pillow bottom edge 16. Pillow 10 has a second thickness 94 extending between pillow top surface 30 and pillow bottom surface 32. Pillow second thickness 94 extends along first side 18 and a pillow second side 96 between pillow top edge 14 and pillow bottom edge 16. Second thickness 94 is smaller than first thickness 90 such that pillow 10 is tapered symmetrically from axis of symmetry 22 to first side 18 and second side 96. Tapering pillow 10 provides additional comfort to the person (not shown in FIG. 3) sleeping on their side on pillow 10. Additionally, tapering pillow 10 permits gravity to pull the person's face downward while the person is sleeping on their side and further reduce wrinkling of the person's face.

Recess 62 has a first thickness 100 extending between top surface 80 of first body portion 40 and pillow bottom surface 32. First thickness 100 extends within recess 62 adjacent second body portion second section 52. Recess 62 has a second thickness 102 at pillow first side 18 which is less than thickness 100 such that top surface 80 slopes from second body portion second section 52 to pillow first side 18. Recess 64 is constructed identically and includes first thickness 100 and second thickness 102.

Figure 4:
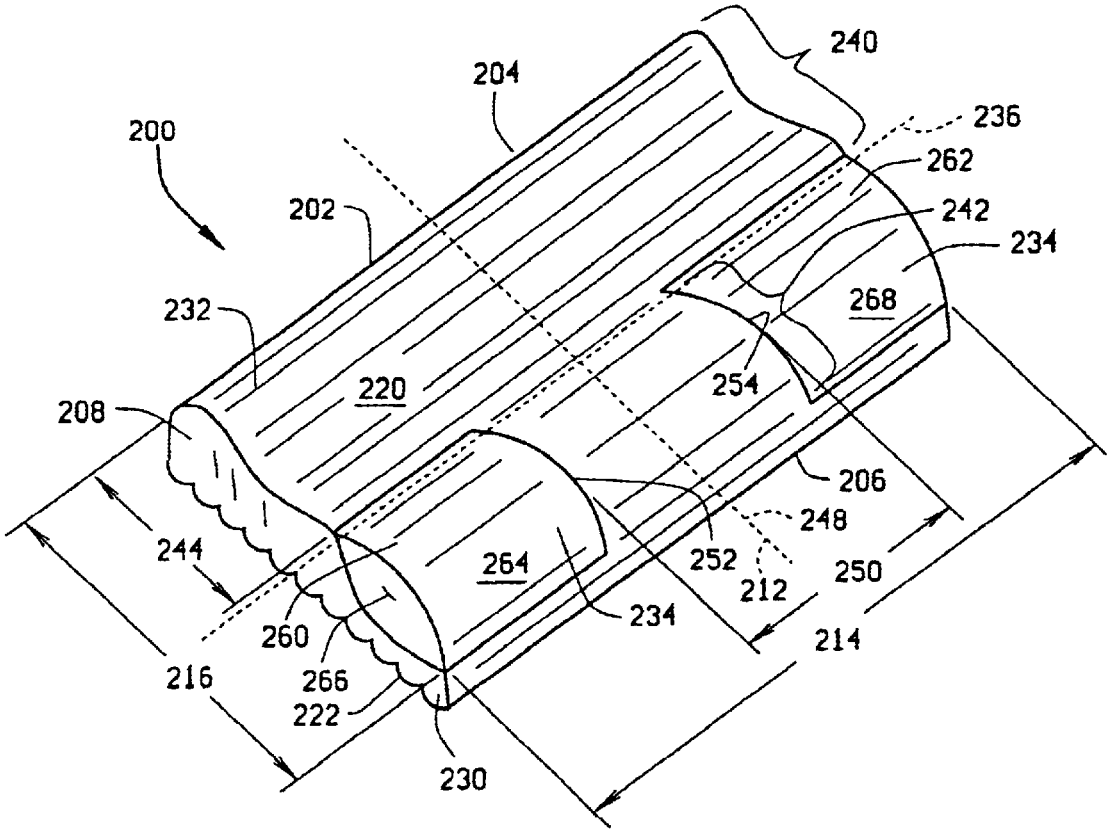
FIG. 4 is a perspective view of an alternative embodiment of a pillow.

FIG. 4 is a perspective view of an alternative embodiment of a pillow 200 including a body 202. Pillow 200 is substantially rectangular in shape and includes a top edge 204, a bottom edge 206 connected to top edge 204 with a first side 208 and a second side (not shown), and an axis of symmetry 212 extending from top edge 204 to bottom edge 206. Pillow 200 includes a width 214 extending between first side 208 and the second side and a length 216 extending between top edge 204 and bottom edge 206. A top surface 220 extends from first side 208 to the second side and from top edge 204 to bottom edge 206. A bottom surface 222 extends from first side 208 to the second side and from top edge 204 to bottom edge 206. Bottom surface 222 includes a plurality of ridges 224 extending from first side 208 to the second side.

Body 202 includes a first body portion 230, a second body portion 232, and a third body portion 234. Second body portion 232 extends from first body portion 230 and first body portion 230 and second body portion 232 are each fabricated from a material (not shown) which is dense and provides a desired level of support to pillow 200.

First body portion 230 is substantially rectangular in shape and includes bottom surface 222 and an axis of symmetry 236. Axis of symmetry 236 extends from pillow first side 208 to the pillow second side and is substantially perpendicular to pillow axis of symmetry 212.

Second body portion 232 is substantially T-shaped and includes a first section 240 and a second section 242. First section 240 extends from first side 208 to the second side. Second body first section 240 has a length 244 extending from top edge 204 to second body portion second section 242. First section length 244 is less than pillow length 216.

Second body portion second section 242 extends from second body portion first section 240 to pillow bottom edge 206. Second body portion second section includes an axis of symmetry 248 which is substantially co-linear with pillow axis of symmetry 212. Second section 242 has a width 250 extending from a first edge 252 of second section 242 to a second edge 254 of second section 242. Width 250 is less than pillow width 214 which creates a first recess (not shown) extending from pillow first side 208 to second body portion second section 242 and from second body portion first section 240 to pillow bottom edge 206. A second recess (not shown) is identical to the first recess and extends from the pillow second side to second body portion second section 242 and from second body portion first section 240 to pillow bottom edge 206. In one embodiment, second body portion second section 242 includes a pair of depressions (not shown) adjacent the first and second recesses, and extending into pillow 200 approximately 0.5 inches to receive a person's ear (not shown).

Third body portion 234 includes a first insert 260 and a second insert 262 fabricated from a second material (not shown) that is different from the material used in fabricating first body portion 230 and second body portion 232. The second material used in fabricating third body portion 234 is less dense than the first material used in fabricating first body portion 230 and second body portion 232 and does not provide support to the person (not shown in FIG. 4) sleeping on pillow 200. Rather, third body portion 234 provides an aesthetic appearance to pillow 200 when a standard pillow case (not shown) is installed over pillow 200.

First insert 260 is attached to pillow 200 and is positioned within the first recess. First insert 260 includes a top surface 264 extending from second body portion first section 240 to pillow bottom edge 206 and is substantially co-planar with pillow top surface 220. First insert 260 also includes a side 266 which is substantially co-planar with pillow first side 208.

Second insert 262 is constructed identically to first insert 260 and includes a top surface 268 which is substantially co-planar with pillow top surface 220 and a side (not shown) which is substantially co-planar with the pillow second side.

Top surface 220 extends over second body portion 232. Top surface 220 is concave over second body portion first section 240 and is convex over second body portion second section 242 which creates a valley-like depression over second body portion first section 240 and an arch-like projection over second body portion second section 242.

Second body portion second section 242 supports a head (not shown in FIG. 4) of the person sleeping. When the person is sleeping on their back, second section concave top surface 30 supports the head and neck of the person sleeping. When the person sleeps on their side, second section concave top surface 30 supports the head of the person while the person's face lightly abuts third body portion inserts 260 and 262. Because the person's face is only in light contact with third body portion inserts 260 and 262, and because third body portion inserts 260 and 262 are fabricated from material intended to provide little or no support to pillow 200, facial wrinkling is alleviated while the person is asleep.

Figure 5:
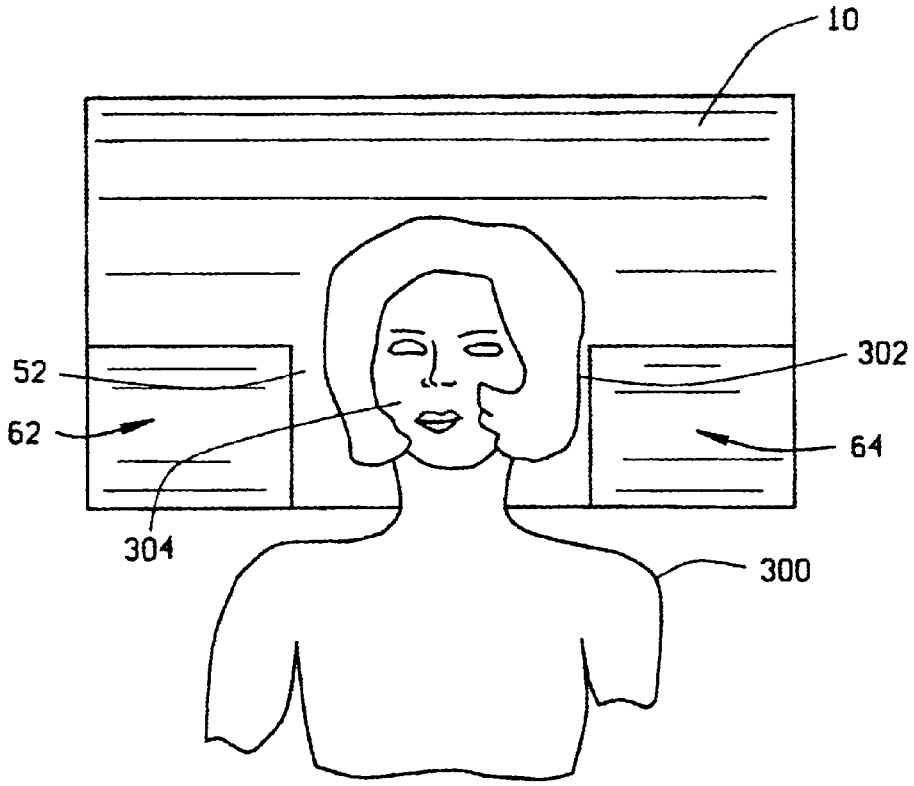
FIG. 5 is a planar view of a person lying on their back and resting their head on the pillow shown in FIG. 1.
Figure 6:
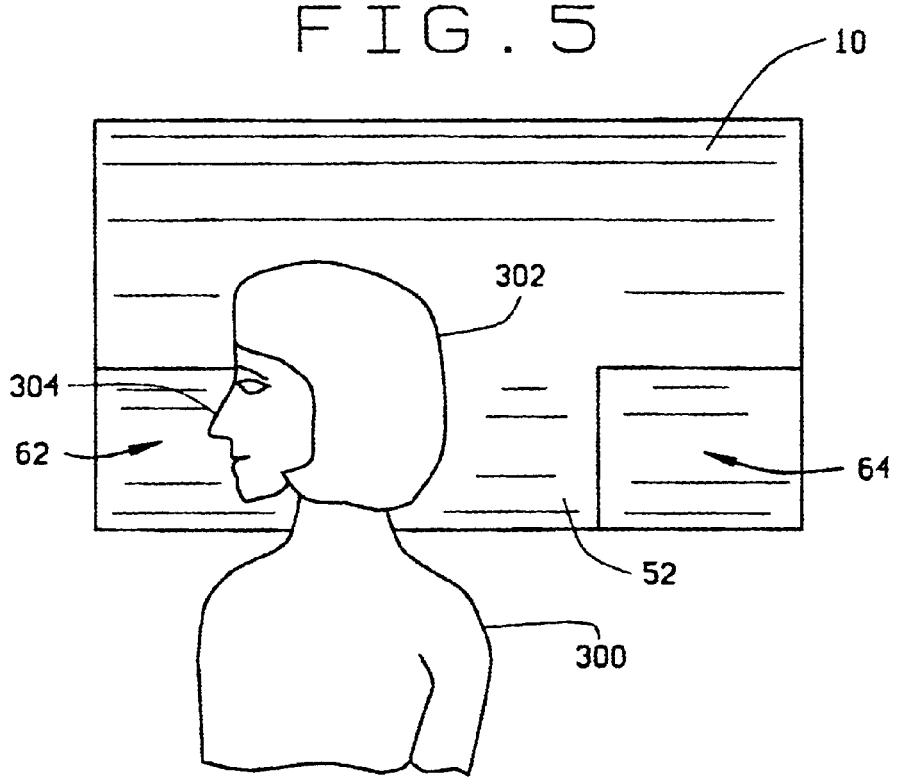
FIG. 6 is a planar view of a person lying on their side and resting their head on the pillow shown in FIG. 1.

FIG. 5 is a planar view of a person 300 lying on their back with their head 302 supported on pillow 10 and FIG. 6 is a planar view of person 300 lying on their side with their head 302 on pillow 10. When person 300 is sleeping on their back, head 302 is supported by pillow second section concave top surface 30 and as such, a person's face 304 is not in contact with pillow 10 and facial wrinkling is not induced.

When person 300 sleeps on their side, recesses 62 and 64 and second body portion second section 52 permit person 300 to sleep on their side with their head 302 supported by second body portion second section 52 while their face 304 is suspended above recesses 62 and 64. Because face 304 is not in contact with pillow 10, facial wrinkling is alleviated while person 300 is asleep.

Figure 7:
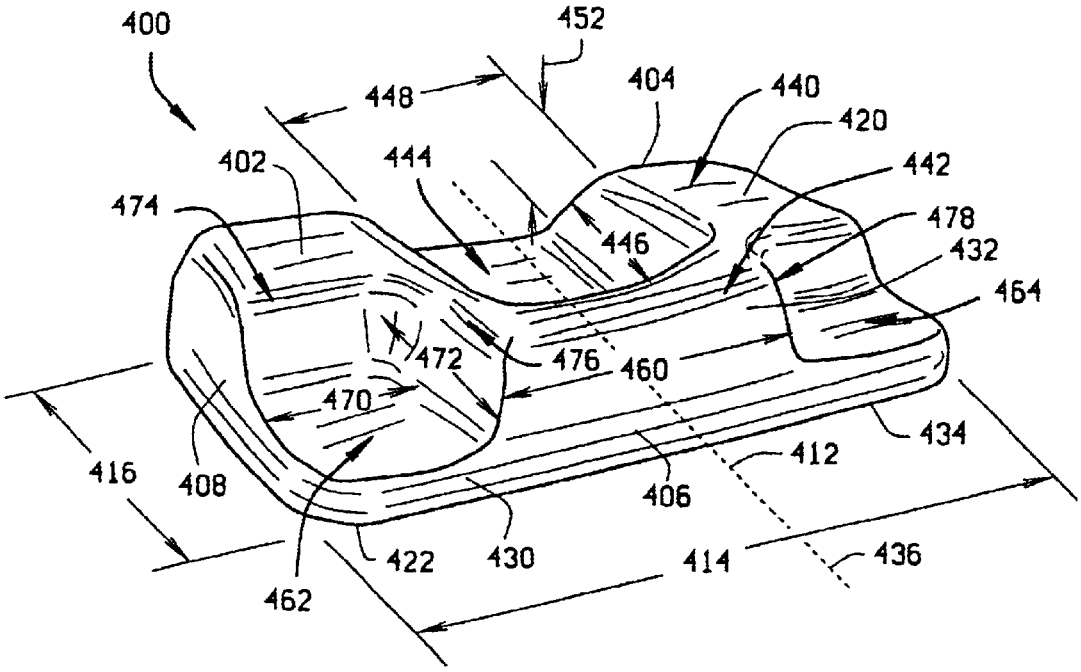
FIG. 7 is a perspective view of another alternative embodiment of a pillow.

FIG. 7 is a perspective view of a pillow 400 including a pliable body 402. Pillow 400 is substantially rectangular in shape and includes a top edge 404, a bottom edge 406 connected to top edge 404 with a first side 408 and a second side (not shown), and an axis of symmetry 412 extending from top edge 404 to bottom edge 406. Pillow 400 has a width 414 extending between first side 408 and the second side, and a length 416 extending between top edge 404 and bottom edge 406. A top surface 420 is substantially planar and extends from first side 408 to the second side and from top edge 404 to bottom edge 406. A bottom surface 422 is substantially planar and extends from first side 408 to the second side and from top edge 404 to bottom edge 406. In one embodiment, pillow 400 is a bladder construction which may be filled with air or fluid.

Body 402 is unitary and includes a first body portion 430 and a second body portion 432 extending from first body portion 430. First body portion 430 and second body portion 432 are fabricated from the same material (not shown). In one embodiment, first body portion 430 and second body portion 432 are constructed from a pliable material which may include foam rubber sponge or fiber material. In a second embodiment, first body portion 430 and second body portion 432 are constructed from a down material.

First body portion 430 is substantially rectangular in shape and includes bottom surface 434 and an axis of symmetry 436. Axis of symmetry 436 extends from pillow first side 408 to the pillow second side and is substantially perpendicular to pillow axis of symmetry 412.

Second body portion 432 is substantially T-shaped and includes first section 440, a second section 442, and a depressed section 444. First section 440 extends from first side 408 to the second side. Depressed section 444 extends from pillow top edge 404 into second body portion second section 442 towards pillow bottom edge 406. More specifically, depressed section 444 extends from pillow top edge 404 towards bottom edge 406 for a length 446. Depressed section length 446 is less than pillow length 416. Additionally, depressed section 444 has a width 448 that is less than pillow width 414.

Depressed section 444 extends into pillow 400 from top surface 420 towards bottom surface 422 for a depth 452. In one embodiment, depressed section depth 452 is approximately equal 1.0 inch.

Second body portion second section 442 extends from first section 440 to pillow bottom edge 406. Top surface 420 extends over second section 442 to pillow bottom edge 406, and over a width 460 of second body portion second section 442. Second body portion second section width 460 is larger than depressed section width 448, and is measured between a first recess 462 and a second recess 464. Accordingly, second body portion second section width 460 is less than pillow width 414.

Second body portion second section 52 (shown in FIG. 1) supports a neck (not shown in FIG. 7) of a person (shown in FIG. 5) sleeping when their head (shown in FIG. 5) is supported within depressed section 444. When a person is sleeping on their back, facial wrinkling is not promoted and second section top surface 420 supports the neck of the person sleeping. However, when a person sleeps on their side, delicate facial skin is placed in contact with pillow 400. Pillow 400 includes recesses 462 and 464 extending from second body portion second section 442 to pillow first side 408 and the pillow second side respectively. In one embodiment, pillow second body portion second section 442 includes a pair of depressions (not shown) adjacent recesses 462 and 464, and extending into pillow 400 approximately 0.5 inches to receive a person's ear (not shown).

Each recess 462 and 464 has a width 470 extending from second section 442 to pillow first side 408 and the pillow second side, respectively, and a length 472 extending from second body portion first section 440 to pillow bottom edge 406. Accordingly, each recess 462 and 464, and second body portion second section 442 permit a person to sleep on their side with their head supported by second body portion second section 442 while their face (not shown) is suspended above recesses 462 and 464. Because the person's face is not in contact with pillow 400, facial wrinkling is alleviated while the person is asleep.

Recess 462 is bordered by a lower edge 474 of second body portion first section 440 and a first edge 476 of second body portion second section 442. Recess 464 is bordered by lower edge 474 of second body portion first section 440 and a second edge 478 of second body portion second section 442.

Figure 8:
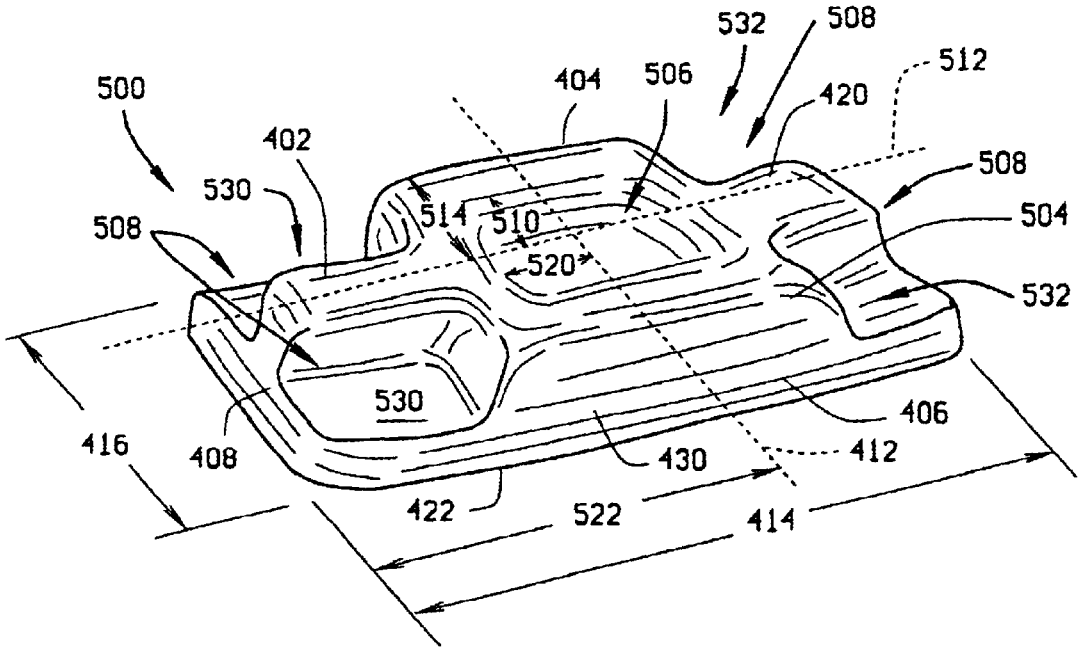
FIG. 8 is a perspective view of a further alternative embodiment of a pillow shown in FIG. 1.

FIG. 8 is a perspective view of a pillow 500. Pillow 500 is substantially similar to pillow 400 shown in FIG. 7 and components in pillow 500 that are identical to components of pillow 400 are identified in FIG. 8 using the same reference numerals used in FIG. 7. Accordingly, pillow 500 includes pliable body 402, top edge 404, bottom edge 406, first side 408, and a second side (not shown). Additionally, pillow 500 has axis of symmetry 412, width 414, and length 416. Pillow top surface 420 and pillow bottom surface 422 are substantially planar and extend from first side 408 to the second side and from top edge 404 to bottom edge 406.

Pillow body 402 is unitary and includes first body portion 430 and a second body portion 504 extending from first body portion 430. First body portion 430 and second body portion 504 are fabricated from the same material (not shown). In one embodiment, first body portion 430 and second body portion 504 are constructed from a pliable material which may include foam rubber sponge or fiber material. In a second embodiment, first body portion 430 and second body portion 504 are constructed from a down material.

Second body portion 504 is substantially shaped as a "+" symbol and includes a center depression 506 and a plurality of recesses 508. More specifically, depression 506 is centered between top surface 420 and pillow bottom surface 422, and between the pillow second side and pillow first side 408. Center depression 506 extends a distance 510 from a second axis of symmetry 512 that extends between pillow first side 408 and the pillow second side. Distance 510 is less than a distance 514 that pillow top edge 404 and pillow bottom edge 406 are located from second axis of symmetry 512. Furthermore, center depression 506 extends a distance 520 from pillow axis of symmetry 412 that is less than a distance 522 that pillow first side 408 and the pillow second side are located from axis of symmetry 412.

Second body portion 504 defines center depression 506 and includes four identical recesses 508 that are substantially identical recesses 462 and 464 (shown in FIG. 7). More specifically, pillow 500 includes a pair of first recesses 530 extending from pillow first side 408 towards the pillow second side, and a pair of second recesses 532 extending from the pillow second side towards pillow first side 408. Each recess 508 has width 470 and length 472 (shown in FIG. 7), and permit a person to sleep on their side with their head supported by second body portion 504 while their face (shown in FIG. 6) is suspended above recesses 508. Because the person's face is not in contact with pillow 500, facial wrinkling is alleviated while the person is asleep. In one embodiment, pillow second body portion 504 includes two pairs of depressions (not shown) adjacent recesses 508, and extending into pillow 500 approximately 0.5 inches to receive a person's ear (not shown).

Figure 9:
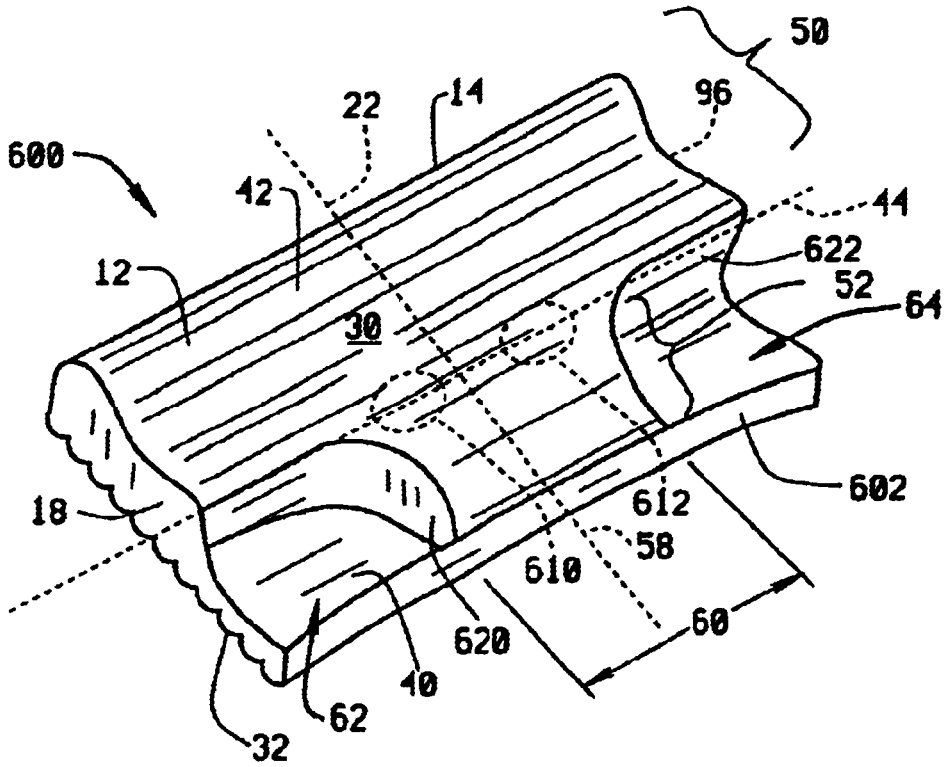
FIG. 9 is a perspective view of another alternative embodiment of the pillow shown in FIG. 1.
Figure 10:
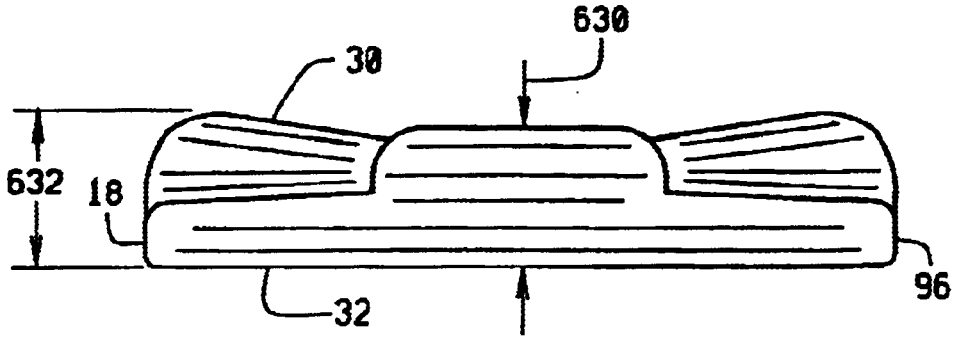
FIG. 10 is a front elevational view of the pillow shown in FIG. 9.

FIG. 9 is a perspective view of another alternative embodiment of a pillow 600. FIG. 10 is a front elevational view of pillow 600. Pillow 600 is substantially similar to pillow 10 shown in FIGS. 1–3, 5, and 6 components of pillow 600 that are identical to components of pillow 10 are identified in FIGS. 9 and 10 using the same reference numerals used in FIGS. 1–3, 5, and 6. Accordingly, pillow 600 includes pillow body 12 which includes a top edge 14, a bottom edge 602 connected to top edge 14 with first and second sides 18 and 96, respectively, and axis of symmetry 22. Pillow 600 also includes top surface 30 and bottom surface 32.

Pillow bottom edge 602 extends between pillow sides 18 and 96. More specifically, pillow bottom edge 602 extends arcuately between sides 18 and 96 such that pillow length 26 along axis of symmetry 22 is less than length 26 along either side 18 or 96.

Body 12 is unitary and includes first body portion 40 and second body portion 42. First body portion 40 includes bottom surface 32 and axis of symmetry 44. Second body portion 42 is substantially T-shaped and includes first section 50 and second section 52. Top surface 30 extends over second body first section 50 and is formed with a concave depression that extends at least partially between first side 18 and second side 96. Alternatively, second body portion first section 50 is constructed such that top surface 30 is substantially flat.

Second body portion second section 52 extends from first section 50 to bottom edge 602. Second body portion second section 52 includes axis of symmetry 58 substantially co-linear with pillow axis of symmetry 22. Top surface 30 extends over second section 52 and extends in a convex arch-like projection between recesses 62 and 64.

Second body portion second section 52 supports a head (not shown in FIG. 1) of a person (not shown in FIG. 1) sleeping. When a person is sleeping on their back, facial wrinkling is not induced and second section concave top surface 30 supports the head and neck of the person sleeping. Second body portion second section 52 also includes a pair of depressions 610 and 612 adjacent recesses 62 and 64, and extending into pillow 600 approximately 0.5 inches to receive a person's ear (not shown). Accordingly, when a person lies on their side and rests their head on pillow 600, their head is supported by second body portion section 52, such that their lower ear is received within either depression 610 or 612 and their face is suspended above either recess 62 or 64. Because the person's face is not in contact with pillow 600, facial wrinkling is alleviated while the person is resting against pillow 600.

Recess 62 is bordered by a continuous sidewall 620 that extends between second body portion sections 50 and 52. More specifically, sidewall 620 extends arcuately from pillow side edge 18 to pillow bottom edge 602. Similarly, recess 64 is also bordered by a continuous sidewall 622 that extends arcuately from pillow side edge 96 to pillow bottom edge 602.

Pillow 600 has a first thickness 630 measured between pillow top surface 30 and pillow bottom surface 32. First thickness 630 extends along pillow axis of symmetry 22 between pillow top edge 14 and pillow bottom edge 602. Pillow 600 has a second thickness 632 extending between pillow top surface 30 and pillow bottom surface 32. Pillow second thickness 632 extends along first side 18 and pillow second side 96 between pillow top edge 14 and pillow bottom edge 602. Second thickness 632 is larger than first thickness 630 such that pillow 600 is upwardly tapered symmetrically from axis of symmetry 22 to pillow sides 18 and 96. Tapering pillow 600 provides additional comfort and support to the person sleeping on their side on pillow 600.

Figure 11:
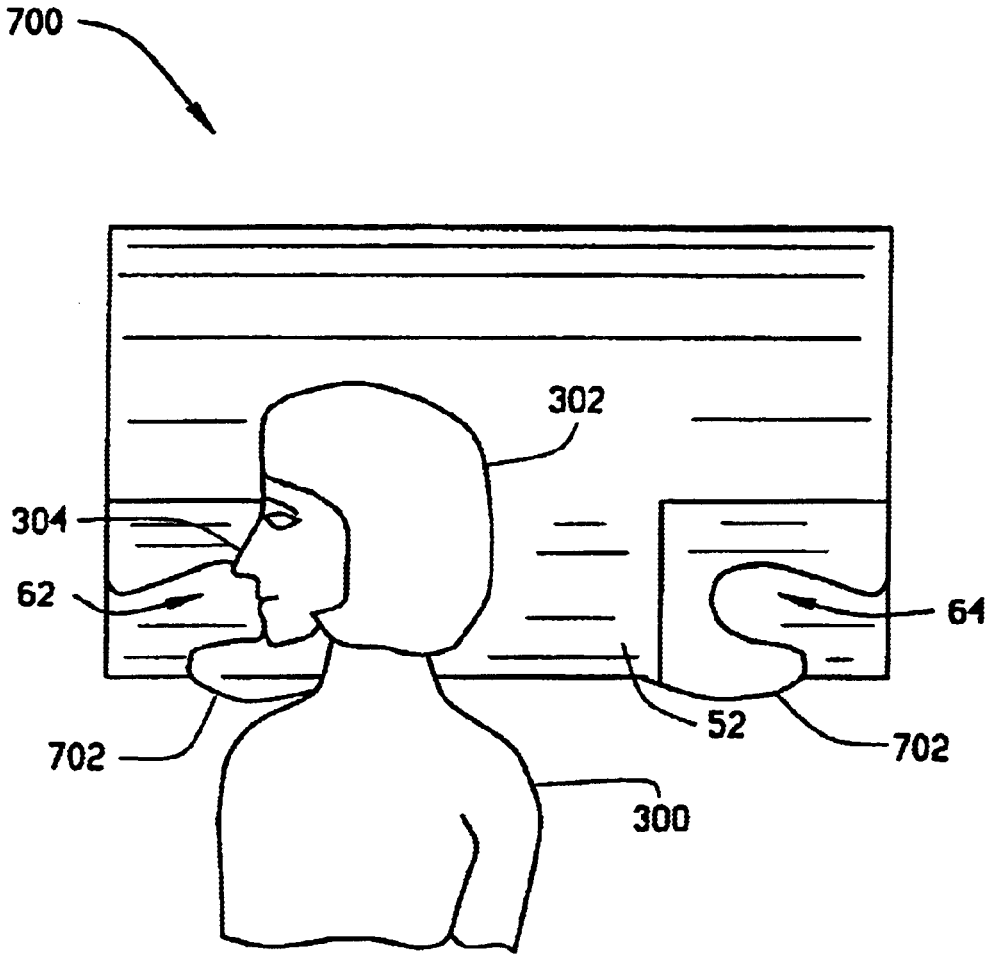
FIG. 11 is a planar view of a person lying on their side and resting their head on a further alternative embodiment of the pillow shown in FIG. 1.

FIG. 11 is a planar view of a person 300 lying on their side and resting their head 302 on a further alternative embodiment of a pillow 700. Pillow 700 is substantially similar to pillow 10 shown in FIGS. 1–3, 5, and 6 components of pillow 700 that are identical to components of pillow 10 are identified in FIG. 11 using the same reference numerals used in FIGS. 1–3, 5, and 6. More specifically, pillow 700 is substantially identical to pillow 10, but also includes a pair of identical chin supports 702. Chin supports 702 extend outwardly from pillow second body portion 52. Specifically, chin supports 702 extend outwardly from second body portion section 52 along pillow bottom edge 602 towards each respective side 18 and 96. Accordingly, at least a portion of each recess 62 and 64 is bordered by each chin support 702.

In the exemplary embodiment, chin supports 702 are arcuately-shaped. In an alternative embodiment, chin supports 702 have any cross-sectional profile that enables each support 702 to function as described herein. More specifically, when person 300 sleeps on their side and rests their head on pillow 700, their head 302 is supported by second body portion section 52, such that their chin is supported by chin support 702, while the remainder of their face is suspended above either recess 62 or 64. Because the majority of the person's face is not in contact with pillow 700, facial wrinkling is alleviated while the person is resting against pillow 700.

The above-described pillow is effective, comfortable, and does not accelerate facial wrinkling. The pillow includes a body which includes a first body portion and a second body portion extending from the first body portion. The first body portion is substantially rectangular-shaped and provides a base for the second body portion which is substantially T-shaped. The second body portion is positioned such that a plurality of recesses extend from the sides of the pillow towards a lower section of the second body portion. Accordingly, an effective and comfortable pillow is provided which inhibits facial wrinkling while a person sleeps.

Exemplary embodiments of pillows are described above in detail. The pillows are not limited to the specific embodiments described herein, but rather, components of each pillow may be utilized independently and separately from other components described herein. Furthermore, each pillow component can also be used in combination with other pillow components. For example, the chin support may be utilized independently and separately from other pillow components described herein.

While the invention has been described in terms of various specific embodiments, those skilled in the art will recognize that the invention can be practiced with modification within the spirit and scope of the claims.

What is claimed is:

1. A pillow comprising:

a first body portion comprising a top edge and a bottom edge connected by a first side edge and a second side edge; and a continuous second body portion extending from said first body portion, said second body portion extending continuously from said top edge to said bottom edge, and continuously between said first and second side edges, said first body portion substantially rectangular-shaped, said continuous second body portion defining at least one recess, said recess bordered by a continuous sidewall formed by said second body portion, said recess sidewall extends arcuately from at least one of said first side edge and said second side edge, said pillow further comprises an axis of symmetry extending from said top edge to said bottom edge, and wherein said second body portion further comprises a plurality of indentations, each of said plurality of indentations is defined entirely within said second body portion.

2. A pillow in accordance with claim 1 wherein at least one of said first body portion top edge and said first body portion bottom edge extends arcuately between said first and second side edges.

3. A pillow in accordance with claim 1 wherein said second body includes an axis of symmetry that is substantially co-linear with said pillow axis of symmetry.

4. A pillow in accordance with claim 1 wherein said pillow further comprises an upper surface, a lower surface, and a thickness measured therebetween, said pillow is tapered from a mid point of said axis of symmetry towards said first side edge and said second side edge, such that a first thickness of said pillow at said axis of symmetry midpoint is different than a second thickness of said pillow thickness of said pillow along at least a portion of said first and second side edges.

5. A pillow in accordance with claim 4 wherein said pillow is upwardly tapered from said axis of symmetry towards said first and second side edges, such that said pillow second thickness is wider than said first pillow thickness.

6. A pillow in accordance with claim 1 wherein said second body portion plurality of indentations are each located a distance from said pillow axis of symmetry and is between said pillow axis of symmetry and at least one of said first and second side edges.

7. A pillow in accordance with claim 1 further comprising at least one chin support extending outwardly from at least one of said first body portion and said second body portion.

8. A pillow in accordance with claim 7 wherein said at least one chin support extending outwardly from said second body portion such that said at least one recess is defined at least partially between said at least one chin support and said second body portion.

9. A pillow comprising a substantially rectangular shaped body comprising a first side, a second side, a bottom side, a top side, a plurality of recesses, a support section extending substantially perpendicularly upwardly from said base, and at least one indentation defined within said support section and located between said pillow axis of symmetry and at least one of said first and second side edges, each said recess at least partially bordered by a continuous wall portion extending from at least one of said first side and said second side, said pillow first side connected to said pillow second side with said top side and said bottom side, at least one of said pillow top side and said bottom side extends arcuately between said pillow first and second sides.

10. A pillow in accordance with claim 9 wherein at least one of said plurality of recesses is bordered by a continuous sidewall formed by said support section such that said sidewall extends arcuately from at least one of said first side and said second side.

11. A pillow in accordance with claim 9 wherein said pillow body further comprises an upper surface, and an opposite lower surface, said body tapered such that a thickness of said body measured between said upper and lower surfaces is variable between said pillow first and second sides.

12. A pillow in accordance with claim 11 wherein said pillow further comprises an axis of symmetry extending from said top side to said bottom side, said pillow is upwardly tapered from said axis of symmetry such that a thickness of said pillow along said first and second sides is larger than a thickness of said pillow along said axis of symmetry.

13. A pillow in accordance with claim 9 wherein said support section further comprises a cavity centered between said pillow first and second sides, said at least one indentation between said cavity and at least one of said plurality of recesses.

14. A pillow in accordance with claim 9 further comprising a chin support extending outwardly from at least one of said base and said support section.

15. A pillow in accordance with claim 14 wherein said chin support extends outwardly from said support section such that at least one of said plurality of recesses extends at least partially between said support section and said chin support.

* * * * *